US012601112B2

(12) United States Patent
Ota et al.

(10) Patent No.: US 12,601,112 B2
(45) Date of Patent: Apr. 14, 2026

(54) MATERIAL STORAGE APPARATUS, METHOD OF CONTROLLING MATERIAL STORAGE APPARATUS, AND SHEET MANUFACTURING APPARATUS

(71) Applicant: SEIKO EPSON CORPORATION, Tokyo (JP)

(72) Inventors: Masaki Ota, Matsumoto (JP); Koji Motohashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 18/519,125

(22) Filed: Nov. 27, 2023

(65) Prior Publication Data

US 2024/0175203 A1 May 30, 2024

(30) Foreign Application Priority Data

Nov. 29, 2022 (JP) ..... 2022-189906

(51) Int. Cl.
*D21B 1/32* (2006.01)
*D21B 1/06* (2006.01)
*D21B 1/08* (2006.01)

(52) U.S. Cl.
CPC ..... *D21B 1/32* (2013.01); *D21B 1/06* (2013.01); *D21B 1/066* (2013.01); *D21B 1/08* (2013.01)

(58) Field of Classification Search
CPC ... D21B 1/32; D21B 1/08; D21B 1/06; D21B 1/066
See application file for complete search history.

(56) References Cited

U.S. PATENT DOCUMENTS

2019/0309475 A1 10/2019 Inagaki et al.
2024/0102239 A1* 3/2024 Hasebe ..... D21H 11/14
2024/0102240 A1* 3/2024 Sakurada ..... D21F 9/00

FOREIGN PATENT DOCUMENTS

CN 109463794 A * 3/2019 ..... A24B 9/00
CN 109996995 A 7/2019
CN 217906253 U * 11/2022
JP 2011-149106 A 8/2011
WO 2011/089942 A1 7/2011

OTHER PUBLICATIONS

English Machine Translation of CN109463794A, 2019 (Year: 2019).*
Kadtronix, Hvac Shutoff for Doors and Windows, Jun. 2021 [downloaded online from archive.org on Sep. 23, 2025], (Year: 2021).*

* cited by examiner

*Primary Examiner* — Anthony Calandra
(74) *Attorney, Agent, or Firm* — Spencer Fane LLP

(57) ABSTRACT

A material storage apparatus includes: a material storage portion configured to store scraps of paper and including a material container and a lid, the material container having a material inlet enabling the scraps of paper to be input into the material container, the lid being configured to open and close the material inlet; a humidification portion including a first blower and configured to supply humidified air into the material container; and an air circulation portion including a second blower and configured to suck air in the material container, and when the lid is open, the material container has a negative pressure.

10 Claims, 10 Drawing Sheets

MATERIAL STORAGE APPARATUS, METHOD OF CONTROLLING MATERIAL STORAGE APPARATUS, AND SHEET MANUFACTURING APPARATUS

The present application is based on, and claims priority from JP Application Serial Number 2022-189906, filed Nov. 29, 2022, the disclosure of which is hereby incorporated by reference herein in its entirety.

BACKGROUND

1. Technical Field

The present disclosure relates to a material storage apparatus, a method of controlling the material storage apparatus, and a sheet manufacturing apparatus.

2. Related Art

As disclosed in JP-A-2011-149106, a paper-material supply apparatus for supplying shredded paper material to a target location has been disclosed. The paper-material supply apparatus includes: a hollow transportation path member having a transportation space inside; a paper-material input portion located upstream of the transportation path member and configured to input paper material into the transportation path member; a discharge portion located downstream of the transportation path member and configured to discharge the paper material from the transportation path member to a target location; and a blower configured to blow air into the transportation path member to generate an air flow that sends the paper material input from the paper-material input portion into the transportation path member to the discharge portion.

In such a paper-material supply apparatus, a certain amount of paper material is input into the paper-material input portion from outside. In this process, paper material and paper dust can be blown upward due to convection that occurs when the paper material is input, a force of impact on the paper material stored in the paper-material input portion, and the like, and thus, paper material and the like can be blown out of the paper-material input portion.

SUMMARY

A material storage apparatus includes: a material storage portion configured to store scraps of paper and including a material container and a lid, the material container having a material inlet enabling the scraps of paper to be input into the material container, the lid being configured to open and close the material inlet; a humidification portion including a first blower and configured to supply humidified air into the material container; and an air circulation portion including a second blower and configured to suck air in the material container, and when the lid is open, the material container has a negative pressure.

A sheet manufacturing apparatus includes the material storage apparatus described above.

A method of controlling a material storage apparatus is a method of controlling a material storage apparatus including a material storage portion configured to store scraps of paper and including a material container and a lid, the material container having a material inlet enabling the scraps of paper to be input into the material container, the lid being configured to open and close the material inlet; a humidification portion including a first blower and configured to supply humidified air into the material container; and an air circulation portion including a second blower and configured to suck air in the material container, the method including causing the material container to have a negative pressure when the lid is open.

DESCRIPTION OF EMBODIMENTS

1. First Embodiment

Figure 1:
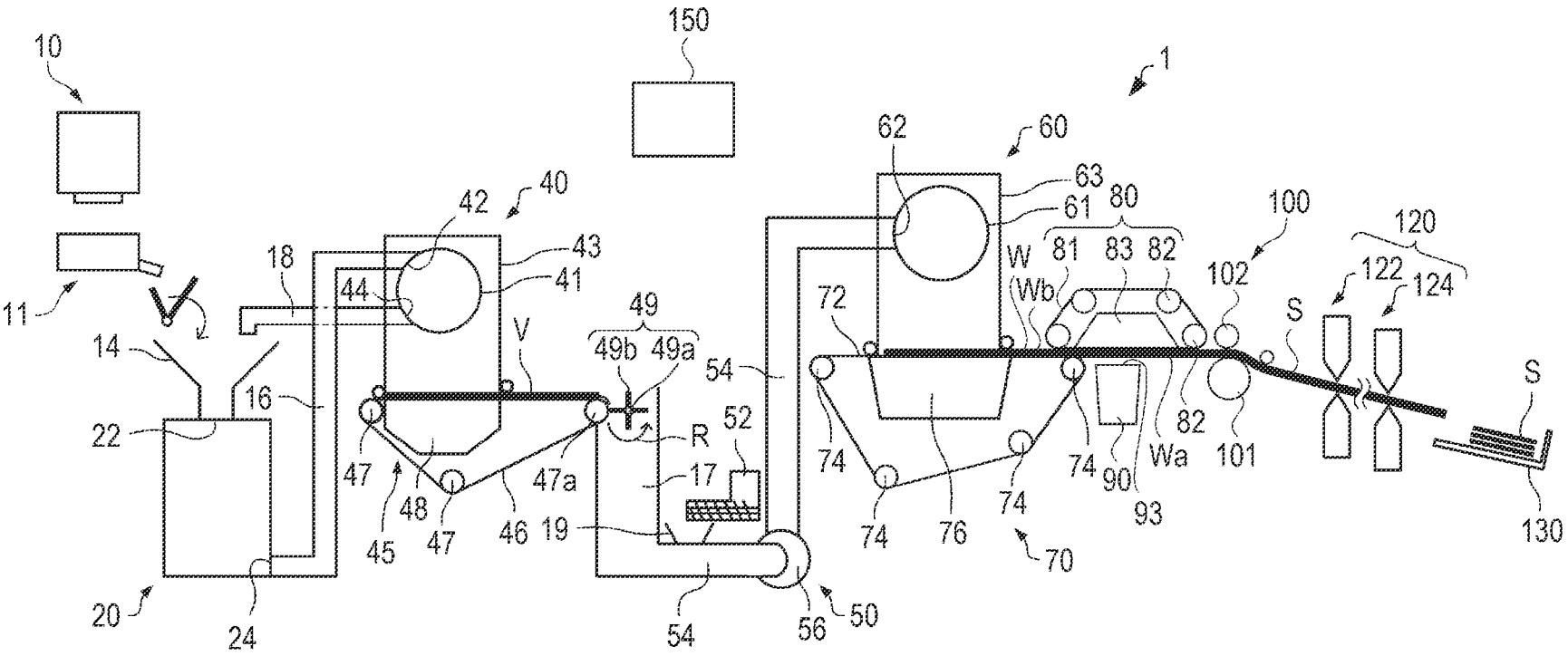
FIG. 1 is a schematic diagram illustrating the configuration of a sheet manufacturing apparatus according to a first embodiment.

First, the configuration of a sheet manufacturing apparatus 1 will be described. The sheet manufacturing apparatus 1 is configured to form sheets S. As illustrated in FIG. 1, the sheet manufacturing apparatus 1 includes a material storage apparatus 10, a fixed-amount supply section 11, a defibration section 20, a screening section 40, a first web-formation section 45, a rotator 49, a mixing section 50, a depositing section 60, a web transportation section 80, a humidification section 90, a pressing section 100, and a cutting section 120. The sheet manufacturing apparatus 1 further includes a controller 150 configured to control driving mechanisms for the material storage apparatus 10, the above sections, and the like.

The material storage apparatus 10 is configured to store raw material. The raw material stored in the material storage apparatus 10 contains various kinds of fiber.

The fiber is not particularly limited, and a wide range of fiber materials can be used. Examples of the fiber include natural fibers (such as animal fibers and plant fibers) and chemical fibers (such as organic fibers, inorganic fibers, and organic-inorganic composite fibers). More specifically, examples of the fiber include ones made of cellulose, silk, wool, cotton, hemp, kenaf, flax, ramie, jute, Manila hemp, sisal hemp, conifers, and broad-leaved trees. These may be used alone, mixed as appropriate, or used as a regenerated fiber subjected to refinement.

Examples of raw materials of the fiber include pulp, used paper, and used cloth. The fiber may be subjected to various kinds of surface treatments. The material of the fiber may be a pure substance or may be a material containing a plurality of components such as impurities and other components. For the fiber, a defibrated material obtained by defibrating used paper, pulp sheets, or the like in a dry process may be used.

Although the length of fibers is not particularly limited, the length of one separate fiber in the longitudinal direction is 1 μm or more and 5 mm or less, preferably 2 μm or more and 3 mm or less, or more preferably 3 μm or more and 2 mm or less.

In the sheet manufacturing apparatus 1, moisture is applied in the humidification section 90, and hence, use of a fiber capable of forming hydrogen bonds increases the mechanical strength of the formed sheet S. An example of such a fiber is cellulose.

The fiber content of the sheet S is, for example, 50 mass % or more and 99.9 mass % or less, preferably 60 mass % or more and 99 mass % or less, or more preferably 70 mass % or more and 99 mass % or less. Such a content can be achieved by blending at a specific ratio when forming a mixture.

The material storage apparatus 10 in the present embodiment stores scraps of paper. The scraps of paper here are used paper or the like cut by shredders or the like. In terms of shape and size, the scraps of paper are, for example, small pieces of several millimeters square to several centimeters square. The scraps of paper stored in the material storage apparatus 10 are supplied to the fixed-amount supply section 11. Details of the configuration of the material storage apparatus 10 will be described later.

The fixed-amount supply section 11 (for example, a load cell) measures the weight of scraps of paper and supplies a fixed weight of scraps of paper to the defibration section 20 through a hopper 14 as appropriate.

The defibration section 20 defibrates the supplied raw material (scraps of paper). Here, "defibrating" denotes unraveling, into individual fibers, a raw material in which a plurality of fibers are bound. The defibration section 20 also has a function of separating substances such as resin particles, ink, toner, and anti-bleed agents attached to the raw material from the fibers.

The material having passed through the defibration section 20 is referred to as "defibrated material". A defibrated material contains not only unraveled fibers but sometimes also contains resin particles separated from fibers when the fibers are unraveled, coloring agents such as ink and toner, and additives such as anti-bleed agents and paper strengthening agents. The shape of an unraveled defibrated material is string-like. An unraveled defibrated material may be in a state of not being tangled with other unraveled fibers, in other words, in a separate state, or it may be in a clumped state in which an unraveled defibrated material is tangled with other unraveled defibrated materials, in other words, in a state in which clumps are formed.

The defibration section 20 performs defibration as a dry process. Here, performing a process such as defibration not in a liquid but in a gas such as air is referred to as a dry process. The defibration section 20 employs, for example, an impeller mill. The defibration section 20 has a function of generating an air flow for sucking the raw material and discharging the defibrated material. With this function, by using the air flow generated by the defibration section 20, the defibration section 20 can suck the raw material from an inlet 22 together with the air flow, perform defibration, and transport the defibrated material to an outlet 24. The defibrated material having passed through the defibration section 20 is transported to the screening section 40 through a pipe 16. The air flow for transporting the defibrated material from the defibration section 20 to the screening section 40 is not limited to the air flow generated by the defibration section 20. An air-flow generation apparatus such as a blower may be provided, and the generated air flow may be used.

The screening section 40 receives the defibrated material defibrated by the defibration section 20 through an inlet 42 and screens the defibrated material according to fiber length. The screening section 40 includes, for example, a drum 41 and a housing 43 that houses the drum 41. The drum 41 may be, for example, a sieve. The drum 41 includes a net and is capable of separating fibers or particles smaller the size of the mesh of the net from fibers, undefibrated scraps, and clumps larger the size of the mesh of the net into a first screened material that passes through the net while leaving a second screened material that does not pass through the net. For example, the first screened material is transported to the depositing section 60 through a pipe 17. The second screened material is returned to the defibration section 20 through an outlet 44 and a pipe 18. Specifically, the drum 41 is a cylindrical sieve rotationally driven by a motor. The net of the drum 41 is, for example, a wire net, an expanded metal formed by stretching a metal plate having cuts, and a perforated metal formed by perforating a metal plate by using a press machine or the like.

The first web-formation section 45 transports the first screened material having passed through the screening section 40 to the pipe 17. The first web-formation section 45 includes, for example, a mesh belt 46, tension rollers 47, and a suction mechanism 48.

The suction mechanism 48 is configured to draw the first screened material having passed through the openings of the screening section 40 and dispersed in air onto the mesh belt 46. This configuration enables the first screened material to accumulate on the moving mesh belt 46.

The first screened material having passed through the openings of the screening section 40 accumulates on the mesh belt 46. The mesh belt 46 is stretched on the tension rollers 47 and configured in a manner such that it is difficult for the first screened material to pass through but easy for air to pass through. The mesh belt 46 is moved by the rotation of the tension rollers 47. The first screened material having passed through the screening section 40 continuously falls and accumulates on the mesh belt 46 moving continuously, forming a web V on the mesh belt 46.

The suction mechanism 48 is located below the mesh belt 46. The suction mechanism 48 is configured to generate a downward air flow. The suction mechanism 48 enables the first screened material dispersed in air by the screening section 40 to be drawn onto the mesh belt 46. This configuration enables an increase in the speed of discharge from the screening section 40.

The web V, which is formed of the material having passed through the screening section 40 and the first web-formation section 45, contains a large amount of air and is soft and puffy. The web V accumulated on the mesh belt 46 is input into the pipe 17 and is transported to the depositing section 60.

The rotator 49 cuts the web V. In the illustrated example, the rotator 49 includes a base 49*a* and protrusions 49*b* protruding from the base 49*a*. Each protrusion 49*b* has, for example, a plate shape. In the illustrated example, the number of the protrusions 49*b* is four, and the four protrusions 49*b* are located at equal intervals. When the base 49*a* rotates in the direction R, the protrusions 49*b* rotate with the base 49*a* as their axis. The rotator 49, which cuts the web V, decreases, for example, the variation in the amount of fiber per unit time to be supplied to the depositing section 60.

The rotator 49 is located near the first web-formation section 45. In the illustrated example, the rotator 49 is located near a tension roller 47*a* located downstream on the path of the web V. The rotator 49 is located at a position where the protrusions 49*b* can come into contact with the web V and do not come into contact with the mesh belt 46 on which the web V is accumulated. This configuration prevents the mesh belt 46 from being worn by the protrusions 49*b*. The minimum distance between the protrusions 49*b* and the mesh belt 46 is, for example, 0.05 mm or more and 0.5 mm or less. This is the distance at which the protrusions 49*b* can cut the web V without damaging the mesh belt 46.

The mixing section 50 mixes the first screened material (fibers) having passed through the screening section 40 with starch serving as a binder. The mixing section 50 includes a starch supply portion 52 that supplies starch, a pipe 54 that transports the first screened material and the starch, and a blower 56. In the illustrated example, starch is supplied from the starch supply portion 52 into the pipe 54 through a hopper 19. The pipe 54 is coupled to the pipe 17.

In the mixing section 50, the blower 56 generates an air flow, which transports the first screened material and the starch while mixing the first screened material and the starch in the pipe 54. Note that the mechanism for mixing the first screened material and the starch is not particularly limited and may be one that performs stirring with high-speed rotary blades or one that utilizes the rotation of a container, such as a V blender.

The starch supply portion 52 can be a screw feeder, a disk feeder, or the like.

The starch supplied from the starch supply portion 52 is a polymer in which a plurality of a-glucose molecules are polymerized by glycosidic bonds. The starch may be linear or branched.

As the starch, various kinds of plant-derived starch can be used. Examples of raw materials for the starch include grains such as corn, wheat, and rice; beans such as fava beans, mung beans, and adzuki beans; tubers such as potatoes, sweet potatoes, and cassavas; wild grasses such as dogtooth violets, brackens, and kudzus; and palms such as sago palms.

As the starch, a modified starch or a starch derivative may be used. Examples of modified starches include acetylated distarch adipate, acetylated starch, oxidized starch, starch sodium octenylsuccinate, hydroxypropyl starch, hydroxypropyl distarch phosphate, monostarch phosphate, phosphated distarch phosphate, urea phosphate esterified starch, sodium starch glycolate, and high-amylose corn starch. Dextrin, a starch derivative, can be obtained by processing or modifying starch and can be suitably used for this purpose.

Use of starch as a binder in the sheet manufacturing apparatus 1 reduces the environmental load, compared with a case of using plastic. Moisture is applied to the fibers (first screened material) containing starch, and the fibers are then pressed and heated. In this process, either or both of bonding between fibers due to the gelatinization of starch and hydrogen bonding between fibers occur, which provides sufficient strength to the sheet S. When the sheet S can have sufficient strength with only hydrogen bonding between fibers, the sheets S may be manufactured without starch. When the sheets S are manufactured without starch, the starch supply portion 52 can be omitted from the sheet manufacturing apparatus 1.

The starch content of the sheet S is, for example, 0.1 mass % or more and 50 mass % or less, preferably 1 mass % or more and 40 mass % or less, or more preferably 1 mass % or more and 30 mass % or less. Such a content can be achieved by blending at a specific ratio when forming a mixture.

Note that the starch supply portion 52 may supply not only starch but also a coloring agent for coloring the fibers, an aggregation inhibitor for inhibiting aggregation of fibers and aggregation of starch, and a flame retardant for reducing the flammability of the fibers and the like, depending on the type of sheet S to be manufactured. The mixture having passed through the mixing section 50 is transported to the depositing section 60 through the pipe 54.

The depositing section 60 receives the mixture having passed through the mixing section 50 through an inlet 62, disentangles tangled fibers, and causes the mixture to fall in air while dispersing the mixture. With this operation, the depositing section 60 enables the mixture to be uniformly accumulated on a second web-formation section 70.

The depositing section 60 includes, for example, a drum 61 and a housing 63 that houses the drum 61. The drum 61 is a cylindrical sieve configured to rotate. The drum 61 has a net that enables fibers or particles contained in the mixture that are smaller than the size of the mesh of the net and that have passed through the mixing section 50 to fall. The configuration of the drum 61 is, for example, the same as that of the drum 41.

Note that the sieve of the drum 61 is not limited to having a function of screening a specific target substance. In other words, the sieve used as the drum 61 denotes a member with a net, and hence, the drum 61 may allow all of the mixture introduced into the drum 61 to fall.

The depositing section 60 includes the second web-formation section 70. The second web-formation section 70 causes the mixture having passed through the drum 61 to accumulate and form a web W. The second web-formation section 70 includes, for example, a first mesh belt 72, tension rollers 74, and a suction mechanism 76.

The mixture having passed through the openings of the depositing section 60 accumulates on the first mesh belt 72. The first mesh belt 72 is stretched on the tension rollers 74 and configured in a manner such that it is difficult for the mixture to pass through and easy for air to pass through. The first mesh belt 72 is moved by the rotation of the tension rollers 74. The mixture having passed through the depositing section 60 continuously falls and accumulates on the first mesh belt 72 moving continuously, forming the web W on the first mesh belt 72.

The suction mechanism 76 is located below the first mesh belt 72. The suction mechanism 76 is configured to generate a downward air flow. The suction mechanism 76 enables the mixture dispersed in air by the drum 61 to be drawn onto the first mesh belt 72. This configuration enables an increase in the speed of discharge from the depositing section 60. In addition, the suction mechanism 76 generates a down flow in the path of the falling mixture, which prevents fibers and starch from tangling while falling.

The web W, which is formed of the material having passed through the depositing section 60 as described above, contains a large amount of air and is soft and puffy.

The web transportation section 80 is located downstream in the transportation direction of the web W on the first mesh belt 72. The web transportation section 80 peels the web W off the first mesh belt 72 and transports the web W toward the pressing section 100. The web transportation section 80 includes a second mesh belt 81 serving as a transportation belt, a plurality of rollers 82, and a suction mechanism 83 serving as a suction portion. The second mesh belt 81 is stretched on the plurality of rollers 82 and configured to enable air to pass through. The second mesh belt 81 is configured to be rotationally driven by the rotation of the rollers 82. The suction mechanism 83 is located at a position facing the web W with the second mesh belt 81 in between. The suction mechanism 83 includes an intake fan (not illustrated), the suction force of which generates an upward air flow passing through the second mesh belt 81. This air flow draws the web W.

With this operation, the web W is peeled off the first mesh belt 72, and the second surface Wb, which is the upper surface, of the web W peeled off the first mesh belt 72 comes into contact with the second mesh belt 81. The web W is held and transported by the second mesh belt 81 with the second surface Wb of the web W in contact with the second mesh belt 81.

The humidification section 90 is located below the web transportation section 80. The humidification section 90 is located so as to face the second mesh belt 81. The humidification section 90 applies moisture to the first surface Wa, which is the lower surface, of the web W being in contact with the second mesh belt 81. The humidification section 90 applies humidified air (for example, water vapor or mist) as moisture to the web W.

The suction mechanism 83 is located at a position facing the humidification section 90 with the second mesh belt 81 in between. The suction mechanism 83 sucks mist discharged from the humidification section 90. Mist discharged from an outlet 93 is sucked by the suction mechanism 83 facing the outlet 93. This configuration enables mist to be sucked by the suction mechanism 83 through the web W and enables moisture to be applied to the web W in the thickness direction.

The water content of the web W to which moisture has been applied in the humidification section 90 is, for example, 12 mass % or more and 40 mass % or less. This water content of the web enables hydrogen bonding to be effectively formed between fibers and increases the strength of the sheet S.

The pressing section 100 is located downstream of the web transportation section 80 and the humidification section 90. The web W with applied moisture is transported to the pressing section 100.

The pressing section 100 presses the humidified web W to form the sheet S. The pressing section 100 includes a first roller 101 configured to be in contact with the first surface Wa of the web W and a second roller 102 configured to be in contact with the second surface Wb of the web W. The first roller 101 and the second roller 102 of the present embodiment each contain a heater (for example, a halogen heater). The pressing section 100 of the present embodiment presses and heats the web W at the same time, which improves productivity in manufacturing the sheet S. This also simplifies the configuration of the sheet manufacturing apparatus 1. After the temperature of the moisture contained in the web W increases, the moisture evaporates, and the thickness of the web W decreases, which increases the density of fibers. In addition to an increase in the temperature of the moisture and the starch due to heat, and an increase in the density of fibers due to the pressing force, the starch gelatinizes, and thereafter, the moisture evaporates, which bonds the fibers together with the gelatinized starch in between. In addition, when the heat causes the moisture to evaporate, and the pressing force increases the density of fibers, a plurality of fibers are bonded together by hydrogen bonding. The cutting section 120 is located downstream of the pressing section 100. The sheet S formed in the pressing section 100 is transported to the cutting section 120.

The cutting section 120 cuts the sheet S formed by the pressing section 100. In the illustrated example, the cutting section 120 includes a first cutting portion 122 configured to cut the sheet S in a direction intersecting the transportation direction of the sheet S and a second cutting portion 124 configured to cut the sheet S in a direction parallel to the transportation direction. The second cutting portion 124 cuts the sheet S having passed through the first cutting portion 122. These processes form a cut sheet S with a specified size and discharge the cut sheet S onto a receiver 130.

Figure 2:
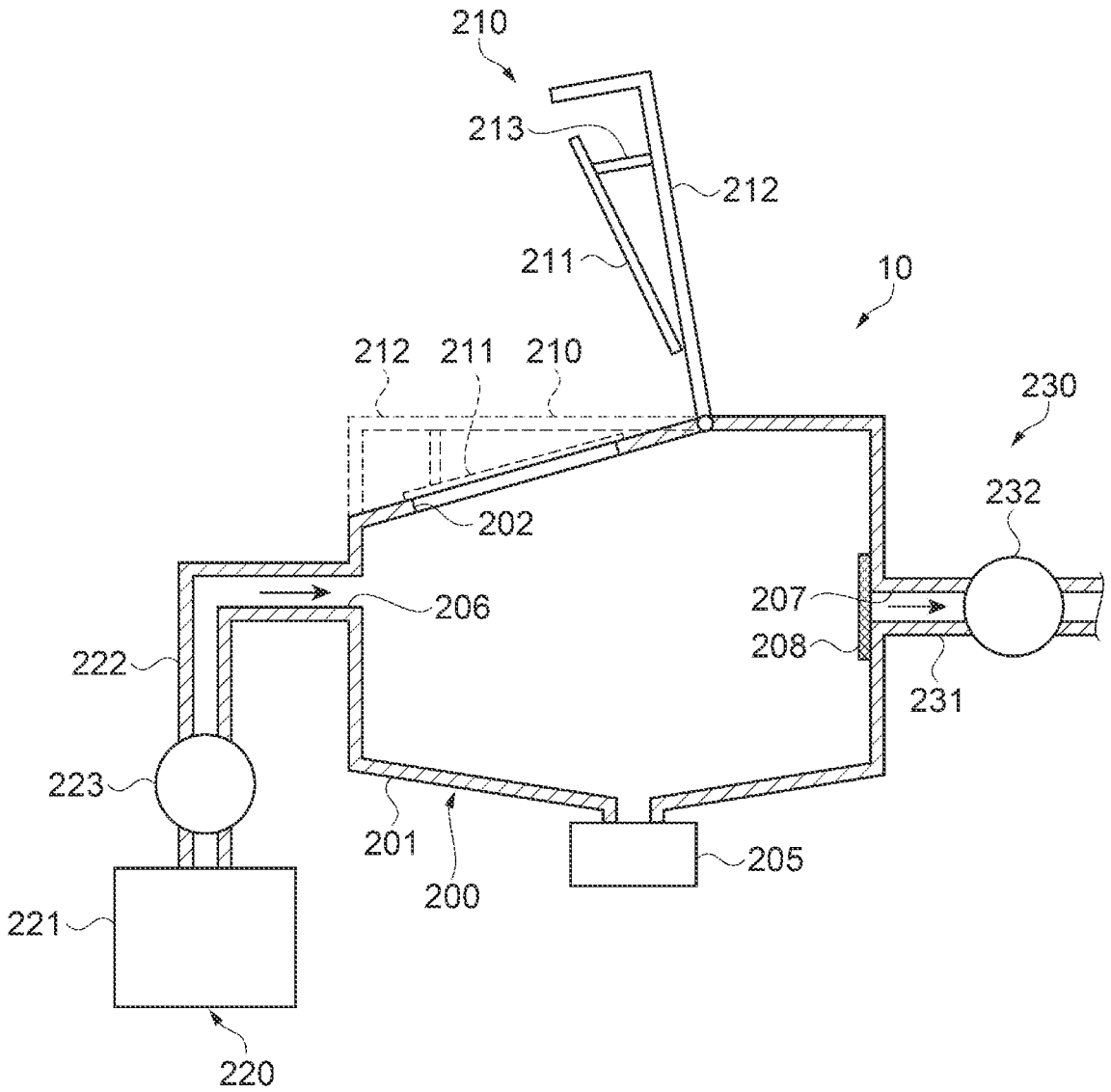
FIG. 2 is a schematic diagram illustrating the configuration of a material storage apparatus according to the first embodiment.
Figure 3A:
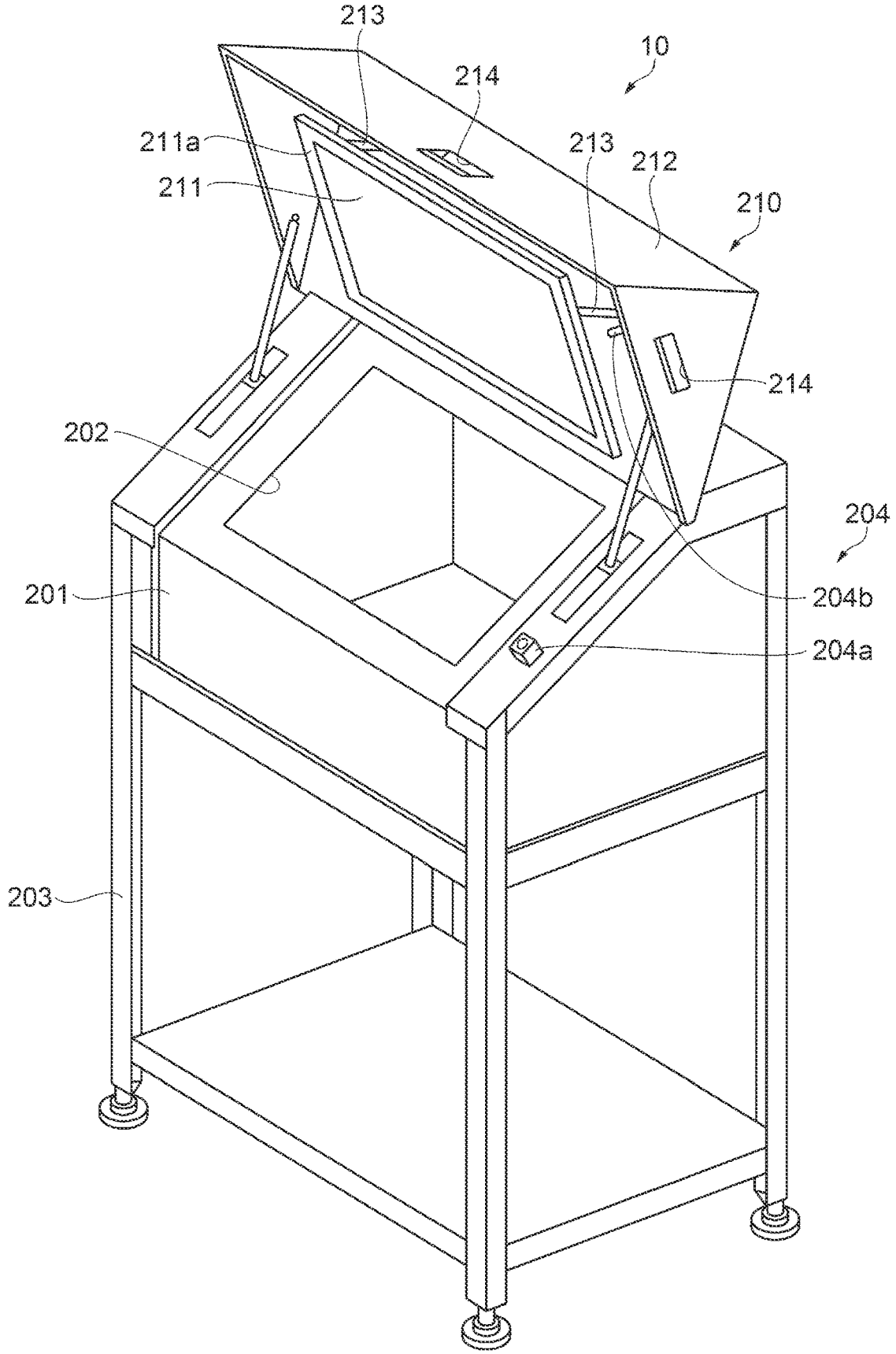
FIG. 3A is an external view diagram illustrating a material storage portion according to the first embodiment.
Figure 3B:
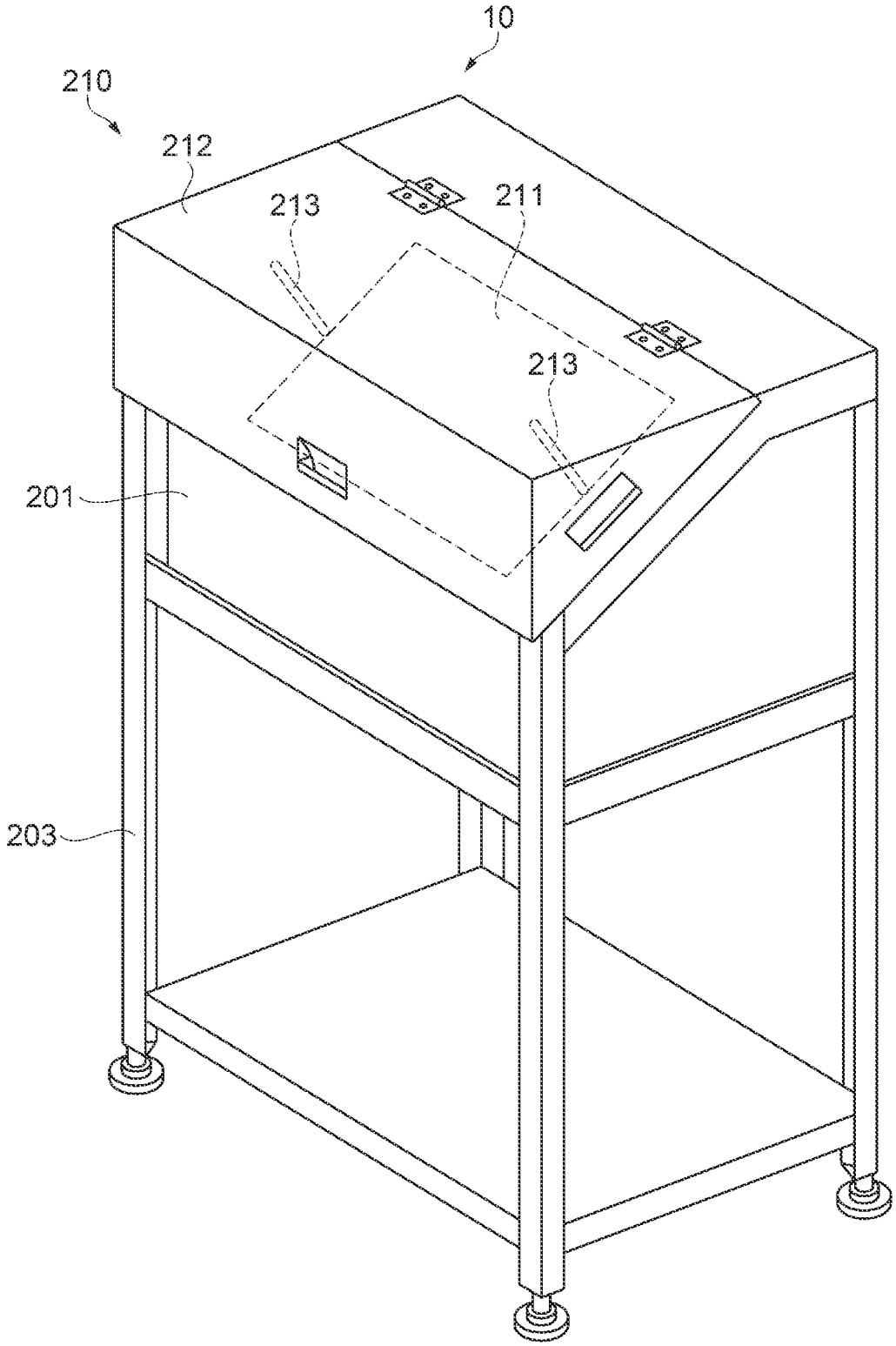
FIG. 3B is an external view diagram illustrating the configuration of the material storage portion according to the first embodiment.

Next, details of the configuration of the material storage apparatus 10 will be described. As illustrated in FIGS. 2, 3A, and 3B, the material storage apparatus 10 includes a material storage portion 200 for storing scraps of paper, a humidification portion 220, and an air circulation portion 230.

The material storage portion 200 includes a material container 201 and a lid 210. The material container 201 is a container configured to contain scraps of paper. The material container 201 of the present embodiment is formed of metal sheets and has an approximately rectangular parallelepiped shape. Note that the material container 201 may be a plastic molding or the like. An upper portion of the material container 201 has a slope intersecting the horizontal directions. The slope extends across the width of the material container 201. The material container 201 has a material inlet 202 in a portion of the slope. The material inlet 202 is an opening formed in a metal sheet and is rectangular. Scraps of paper are input into the material container 201 through the material inlet 202. The material inlet 202 located in a portion of the slope makes it easy to input scraps of paper. The scraps of paper input through the material inlet 202 are stored (reserved) in the material container 201. The material container 201 is supported by, for example, a support stand 203.

The lid 210 is configured to open and close the material inlet 202. In FIG. 3A, the lid 210 is open, and in FIG. 3B the lid 210 is closed. The lid 210 includes an inner lid 211 and an outer lid 212.

The inner lid 211 is a rectangular plate-shaped member. The inner lid 211 is larger than the material inlet 202 so as to cover the entire material inlet 202. The outer periphery of the inner lid 211 is provided with a sealer 211*a* in which a permanent magnet is covered with a resin tube. When the material inlet 202 is closed with the inner lid 211, the sealer 211*a* is brought into close contact with the metal sheet of the material container 201 by a magnetic force, which seals the material inlet 202.

The outer lid 212 is a frame member that covers the inner lid 211. The outer lid 212 is formed of a plate-shaped member, and the inner lid 211 is located in the space inside the outer lid 212. A side surface of the outer lid 212 has a handle 214 recessed in the thickness direction of the outer lid 212. The lid 210 can be easily opened and closed by holding the handle 214 with fingers.

The outer lid 212 is formed such that the upper surface of the outer lid 212 is parallel to the horizontal plane when the lid 210 is closed. More specifically, the upper surface of the outer lid 212 is formed such that the upper surface of the outer lid 212 and the top surface of the material container 201 form a continuous plane parallel to the horizontal directions when the lid 210 is closed. The side surfaces of the outer lid 212 are formed to be parallel to a vertical plane when the lid 210 is closed. More specifically, the side surfaces of the outer lid 212 are formed such that each side surface of the outer lid 212 and the corresponding side surface of the material container 201 form a plane continuous in the vertical direction when the lid 210 is closed. With this configuration, when the lid 210 is closed, the slope formed at an upper portion of the material container 201 is covered with the outer lid 212. In addition, when the lid 210 is closed, each surface of the outer lid 212 is flush with the material container 201, and the lid 210 and the material container 201 have a form of an integrated rectangular parallelepiped, which is aesthetically pleasing.

The inner lid 211 is coupled to the outer lid 212 by coupling portions 213. Each coupling portion 213 has a rod shape, and one end of each coupling portion 213 is coupled to the surface of the inner lid 211 opposite to the surface that comes into contact with the material container 201. The other end of each coupling portion 213 is coupled to the inner surface of the outer lid 212. The outer lid 212 is rotatably coupled to shafts located at upper portions of the material container 201. By rotating the outer lid 212 about the shafts, the outer lid 212 together with the inner lid 211 can be placed in an open state and a closed state. Note that it is preferable that the inner lid 211 and the outer lid 212 be formed of resin materials. This configuration enables a lighter weight than in a case of using a metal material or the like, making it easy to open and close the lid 210.

The material storage portion 200 includes a detector 204 configured to detect whether the lid 210 of the material inlet 202 is open or closed. The detector 204 is coupled to the controller 150. The detector 204 is, for example, an interlocking mechanism including a body 204*a* and an insertion portion 204*b* configured to be inserted into the body 204*a*. The body 204*a* is located at an upper portion of the material container 201. The insertion portion 204*b* is located on the outer lid 212. To open the lid 210 from the closed state, the lid 210 is moved up. In this operation, the insertion portion 204*b* comes out of the body 204*a*. The detector 204 transmits a detection signal to the controller 150 indicating that the state of the contact of the body 204*a* has changed. In accordance with the transmitted detection signal, the controller 150 determines that the lid 210 was opened and that it is now in the open state. In contrast, when the lid 210 is closed from the open state, the insertion portion 204*b* is inserted into the body 204*a*. The detector 204 transmits a detection signal to the controller 150 indicating that the state of the contact of the body 204*a* has changed. In accordance with the transmitted detection signal, the controller 150 determines that the lid 210 was closed and that it is now in the closed state.

The material storage apparatus 10 includes a scrap-paper transportation portion 205 configured to transport the scraps of paper stored in the material container 201 to the fixed-amount supply section 11. The scrap-paper transportation portion 205 is located at a bottom portion of the material container 201. The scrap-paper transportation portion 205 can be a screw feeder, a disk feeder, or the like.

The humidification portion 220 supplies humidified air into the material container 201. Scraps of paper to be input into the material container 201 and the scraps of paper contained in the material container 201 have a static charge because of friction produced during shredding. When scraps of paper have a static charge, they can become tangled with one another and cling to the inner surfaces of the material container 201. These phenomena make it difficult to transport the scraps of paper. In addition, for example, a problem in which scraps of paper cannot be appropriately measured in the fixed-amount supply section 11 can occur. To address such issues, humidified air is supplied into the material container 201 to remove the static charge from the scraps of paper.

The humidification portion 220 includes a humidifier 221 configured to produce humidified air, a coupling pipe 222 coupling the humidifier 221 and an air inlet 206 of the material container 201, and a first blower 223 located at a position on the coupling pipe 222. The humidifier 221 is, for example, of an evaporative type. The first blower 223 includes a plurality of blades and rotates the blades to cause the humidified air produced in the humidifier 221 to flow toward the material container 201 through the coupling pipe 222. The humidified air flows into the material container 201 through the air inlet 206 of the material container 201. The air inlet 206 is located higher than the center portion of the material container 201 in the height direction. This configuration enables humidified air to be supplied to the entire part in the material container 201 without interference from the scraps of paper contained in the material container 201.

The air circulation portion 230 sucks the air in the material container 201. When humidified air is supplied to the material container 201 continuously, the relative humidity in the material container 201 increases excessively. Hence, the air in the material container 201 is sucked and discharged to the outside of the material container 201. This configuration circulates the air in the material container 201 and stabilizes the humidity environment in the material container 201.

The air circulation portion 230 includes an outlet pipe 231 coupled to an outlet 207 of the material container 201 and a second blower 232 located on the outlet pipe 231. The second blower 232 includes a plurality of blades and rotates the blades to discharge the air in the material container 201 to the outside of the material container 201 through the outlet pipe 231. The outlet 207 is located higher than the center portion of the material container 201 in the height direction. This configuration enables the air in the material container 201 to be sucked smoothly without sucking the scraps of paper contained in the material container 201. The portion of the material container 201 where the outlet 207 is located is provided with a mesh filter 208. This configuration prevents scraps of paper from flowing out into the outlet pipe 231.

Figure 4:
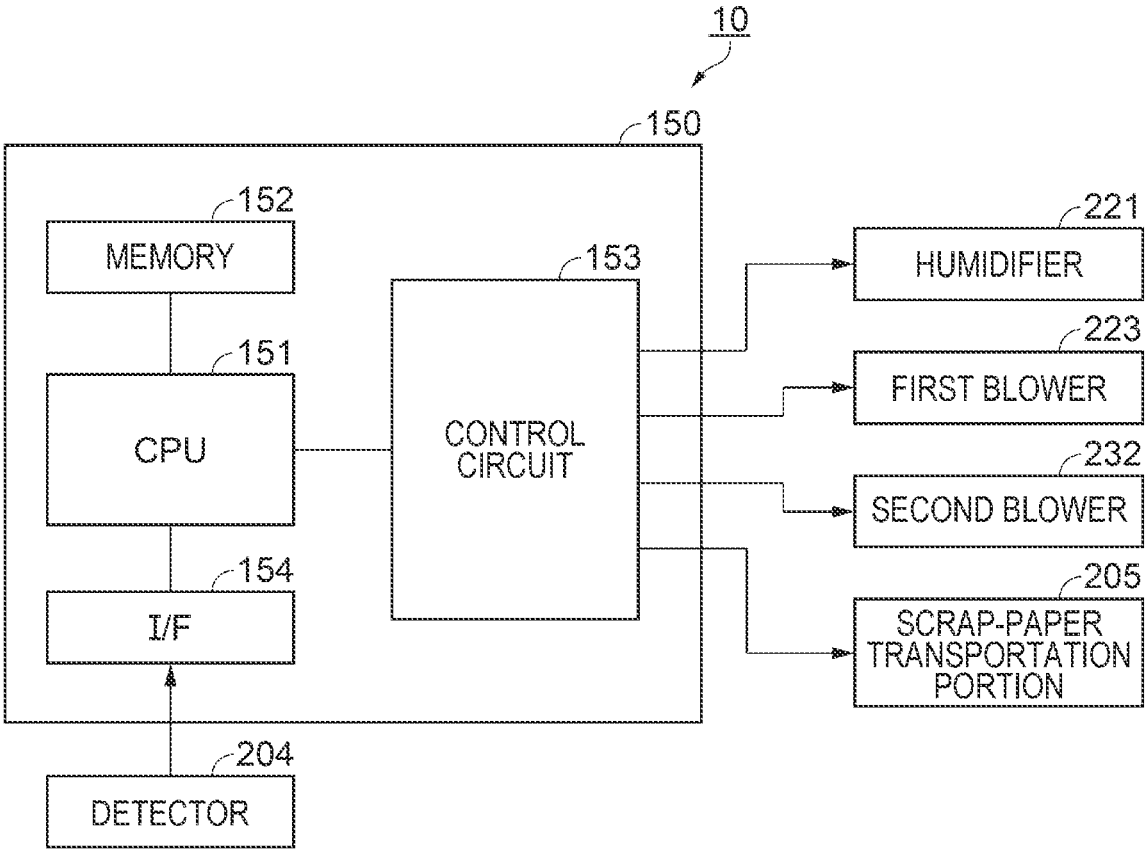
FIG. 4 is a block diagram illustrating the control configuration of the material storage apparatus according to the first embodiment.

Next, the control configuration of the material storage apparatus 10 will be described. As illustrated in FIG. 4, the material storage apparatus 10 is controlled by the controller 150. The controller 150 includes a CPU 151, memory 152, a control circuit 153, and an interface (I/F) 154. The CPU 151 is an arithmetic processing device. The memory 152 is a storage device configured to allocate an area for storing various programs, a work area, and the like and includes a storage element such as RAM or EEPROM. When the controller 150 receives a detection signal and the like from the detector 204 through the I/F 154, the CPU 151 executes arithmetic operations in accordance with the various programs and controls each driven portion through the control circuit 153.

When the lid 210 is closed, the controller 150 drives the humidifier 221, the first blower 223, and the second blower 232. This operation supplies humidified air into the material container 201. In addition, the air in the material container 201 is sucked and circulated. To diffuse humidified air sufficiently in the material container 201, the controller 150 controls the first blower 223 and the second blower 232 such that the flow rate of the humidified air flowing into the material container 201 is higher than the flow rate of the air discharged from the material container 201. Hence, when the lid 210 is closed, the material container 201 has a positive pressure. Note that since the inner lid 211 is in close contact with the material container 201 due to the magnetic force of the sealer 211*a*, the inner lid 211 will not be apart from the material container 201, thereby maintaining the positive pressure in the material container 201.

Here, when scraps of paper are input into the material container 201, if the lid 210 is opened in the state in which the material container 201 has a positive pressure, the air in the material container 201 flows out through the material inlet 202, and there is a possibility of scraps of paper and paper dust blowing out. In addition, since humidified air is discharged to the outside of the material container 201 through the material inlet 202, moisture would be discharged wastefully.

To address this, the material storage apparatus 10 of the present embodiment performs control such that the pressure in the material container 201 is negative when the lid 210 is open. Details are described below. Note that the present embodiment describes a control method in a case in which when the lid 210 is opened from the closed state to input scraps of paper into the material container 201 when the first blower 223 and the second blower 232 are operating.

As described above, when the first blower 223 and the second blower 232 are operating (when the lid 210 is closed), the controller 150 performs control such that the flow rate of the air being caused by the first blower 223 to flow into the material container 201 is higher than the flow rate of the air being caused by the second blower 232 to flow out of the material container 201. This operation retains a positive pressure in the material container 201. Thus, humidified air is appropriately supplied to the material container 201, thereby maintaining the humidity environment in the material container 201.

Figure 5:
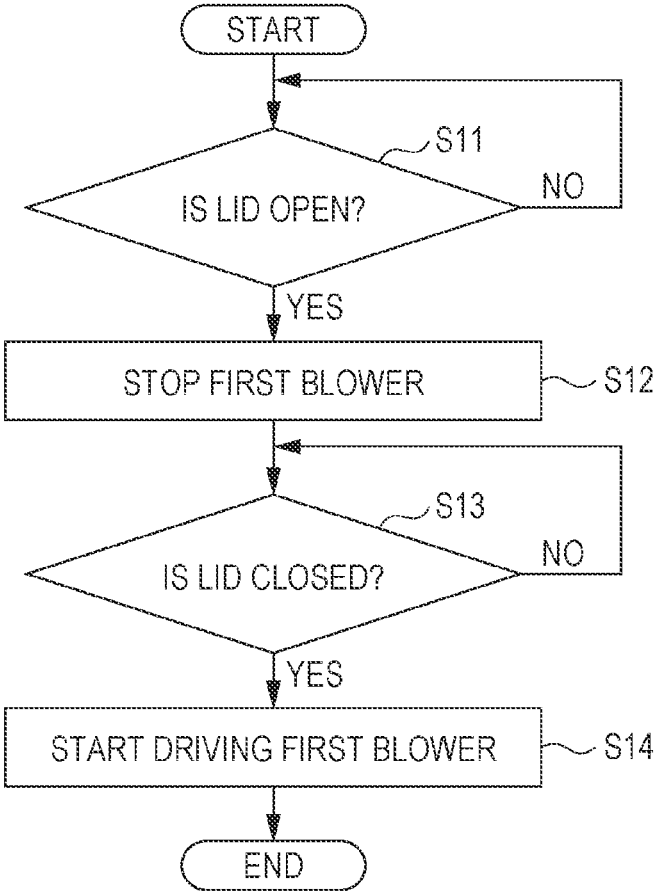
FIG. 5 is a flowchart illustrating a method of controlling the material storage apparatus, according to the first embodiment.

As illustrated in FIG. 5, in step S11, the controller 150 determines whether the lid 210 is open. The controller 150 performs the determination in accordance with the detection signal transmitted from the detector 204. When the controller 150 determines that the lid 210 is open (YES), the process proceeds to step S12. In contrast, when the controller 150 determines that the lid 210 is not open, in other words, the lid 210 is closed (NO), the process remains in step S11.

In step S12, the controller 150 stops the first blower 223. Thus, the flow rate of the air flowing into the material container 201 decreases (the flow rate becomes substantially zero). In contrast, the operation of the second blower 232 is maintained. With this operation, the flow rate of the air being caused by the second blower 232 to flow out of the material container 201 becomes higher than the flow rate of the air being caused by the first blower 223 to flow into the material container 201, and accordingly the pressure in the material container 201 becomes negative in a short time. This operation prevents scraps of paper, paper dust, and the like from blowing out through the material inlet 202 when the lid 210 is opened. Hence, scraps of paper can be smoothly input into the material container 201 through the material inlet 202. Since the first blower 223 is stopped, supply of humidified air is stopped. Accordingly, the amount of humidified air flowing out through the material inlet 202 is reduced, and the loss of moisture is reduced.

When inputting scraps of paper into the material container 201 is finished, the lid 210 is closed from the open state. In step S13, the controller 150 determines whether the lid 210 is closed. The controller 150 performs the determination in accordance with the detection signal transmitted from the detector 204. When the controller 150 determines that the lid 210 is closed (YES), the process proceeds to step S14. In contrast, when the controller 150 determines that the lid 210 is not closed, in other words, the lid 210 is open (NO), the process remains in step S13.

In step S14, the controller 150 starts driving the first blower 223. The controller 150 controls the first blower 223 such that the flow rate reaches a specified level. With this operation, the flow rate of the air flowing into the material container 201 becomes higher than the flow rate of the air being caused by the second blower 232 to flow out of the material container 201, and accordingly the pressure in the material container 201 becomes positive. Thus, humidified air is appropriately supplied to the material container 201, thereby maintaining the humidity environment in the material container 201.

2. Second Embodiment

Next, a second embodiment will be described. Note that the same components as in the first embodiment are denoted by the same reference numerals without repetitive description. The present embodiment describes a method of controlling the material storage apparatus 10. Note that the present embodiment describes a control method in a case in which the lid 210 is opened from the closed state to input scraps of paper into the material container 201 when the first blower 223 and the second blower 232 are operating. When the first blower 223 and the second blower 232 are operating, the pressure in the material container 201 is controlled to be positive as in the first embodiment.

Figure 6:
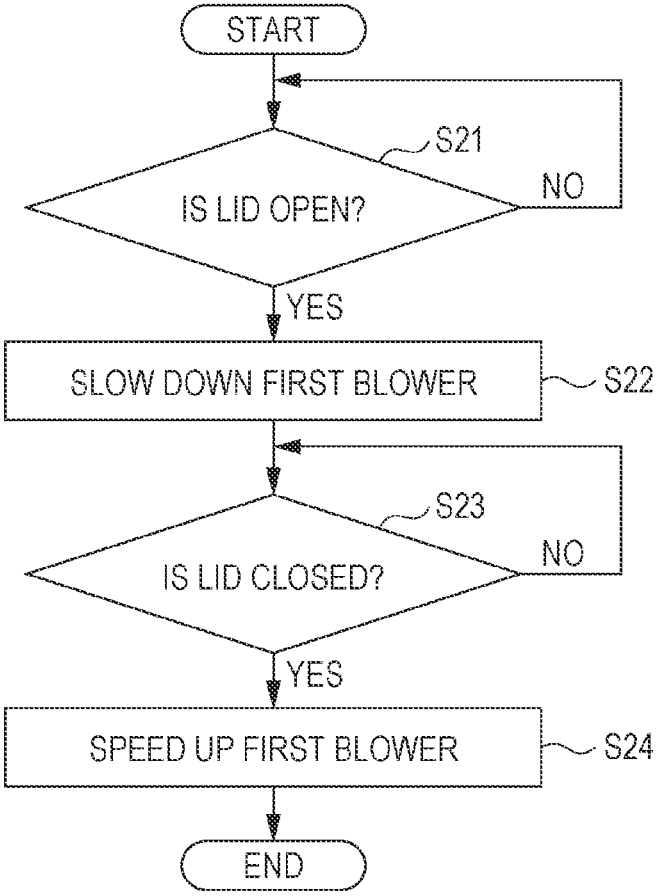
FIG. 6 is a flowchart illustrating a method of controlling the material storage apparatus, according to a second embodiment.

As illustrated in FIG. 6, in step S21, the controller 150 determines whether the lid 210 is open. The controller 150 performs the determination in accordance with the detection signal transmitted from the detector 204. When the controller 150 determines that the lid 210 is open (YES), the process proceeds to step S22. In contrast, when the controller 150 determines that the lid 210 is not open, in other words, the lid 210 is closed (NO), the process remains in step S21.

In step S22, the controller 150 slows down the first blower 223. Accordingly, the flow rate of the air flowing into the material container 201 decreases. In contrast, the operation of the second blower 232 is maintained. With this operation, the flow rate of the air being caused by the second blower 232 to flow out of the material container 201 becomes higher than the flow rate of the air being caused by the first blower 223 to flow into the material container 201, and accordingly the pressure in the material container 201 becomes negative in a short time. This operation prevents scraps of paper, paper dust, and the like from blowing out through the material inlet 202 when the lid 210 is opened. Hence, scraps of paper can be smoothly input into the material container 201 through the material inlet 202. Since the first blower 223 is slowed down, the flow rate of supplied humidified air decreases. Accordingly, the amount of humidified air flowing out through the material inlet 202 is reduced, and the loss of moisture is reduced.

When inputting scraps of paper into the material container 201 is finished, the lid 210 is closed from the open state. In step S23, the controller 150 determines whether the lid 210 is closed. The controller 150 performs the determination in accordance with the detection signal transmitted from the detector 204. When the controller 150 determines that the lid 210 is closed (YES), the process proceeds to step S24. In contrast when the controller 150 determines that the lid 210 is not closed, in other words, the lid 210 is open (NO), the process remains in step S23.

In step S24, the controller 150 speeds up the first blower 223. The controller 150 performs control to speed up the first blower 223 such that the flow rate becomes a specified level. With this operation, the flow rate of the air flowing into the material container 201 becomes higher than the flow rate of the air being caused by the second blower 232 to flow out of the material container 201, and accordingly the pressure in the material container 201 becomes positive. Thus, humidified air is appropriately supplied to the material container 201, thereby maintaining the humidity environment in the material container 201. In addition, since the first blower 223 is not stopped, it is possible to change the flow rate of the first blower 223 to a specified level in a short period.

3. Third Embodiment

Next, a third embodiment will be described. Note that the same components as in the first embodiment are denoted by the same reference numerals without repetitive description. The present embodiment describes a method of controlling the material storage apparatus 10. Note that the present embodiment describes a control method in a case in which the lid 210 is opened from the closed state to input scraps of paper into the material container 201 when the first blower 223 and the second blower 232 are operating. When the first blower 223 and the second blower 232 are operating, the pressure in the material container 201 is controlled to be positive as in the first embodiment.

Figure 7:
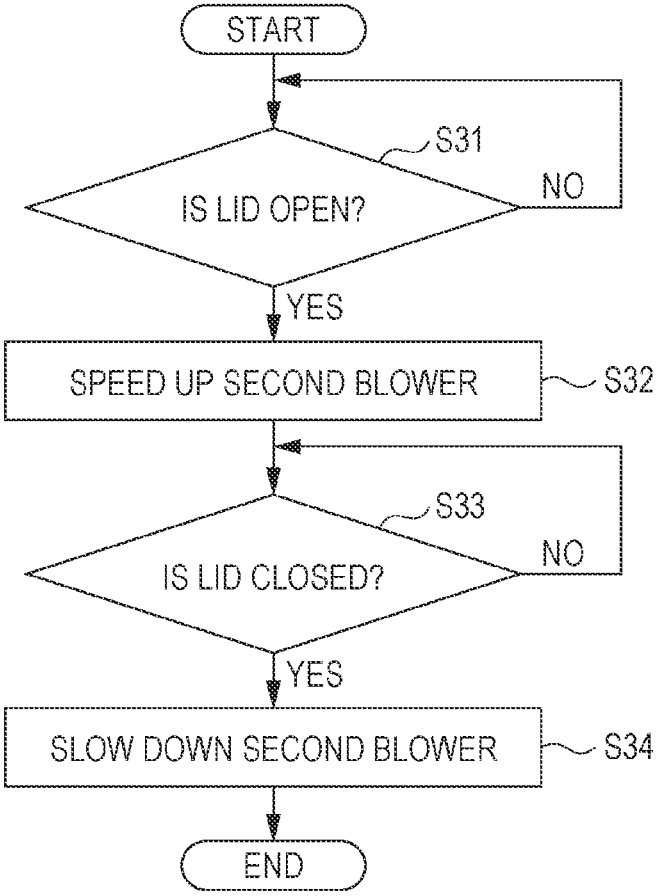
FIG. 7 is a flowchart illustrating a method of controlling the material storage apparatus, according to a third embodiment.

As illustrated in FIG. 7, in step S31, the controller 150 determines whether the lid 210 is open. The controller 150 performs the determination in accordance with the detection signal transmitted from the detector 204. When the controller 150 determines that the lid 210 is open (YES), the process proceeds to step S32. In contrast, when the controller 150 determines that the lid 210 is not open, in other words, the lid 210 is closed (NO), the process remains in step S31.

In step S32, the controller 150 speeds up the second blower 232. Specifically, the controller 150 performs control to speed up the second blower 232 such that the flow rate of the air being caused by the second blower 232 to flow out of the material container 201 is higher than the flow rate of the air being caused by the first blower 223 to flow into the material container 201. With this operation, the flow rate of the air flowing out of the material container 201 increases. In contrast, the operation of the first blower 223 is maintained in a specified condition. With this operation, since the flow rate of the air being caused by the second blower 232 to flow out of the material container 201 becomes higher than the flow rate of the air being caused by the first blower 223 to flow into the material container 201, the pressure in the material container 201 becomes negative in a short time. This operation prevents scraps of paper, paper dust, and the like from blowing out through the material inlet 202 when the lid 210 is opened. Hence, scraps of paper can be smoothly input into the material container 201 through the material inlet 202.

Since the operation of the first blower 223 is maintained, it mitigates the drying of the scraps of paper in the material container 201.

When inputting scraps of paper into the material container 201 is finished, the lid 210 is closed from the open state. In step S33, the controller 150 determines whether the lid 210 is closed. The controller 150 performs the determination in accordance with the detection signal transmitted from the detector 204. When the controller 150 determines that the lid 210 is closed (YES), the process proceeds to step S34. In contrast when the controller 150 determines that the lid 210 is not closed, in other words, the lid 210 is open (NO), the process remains in step S33.

In step S34, the controller 150 slows down the second blower 232. The controller 150 performs control to slow down the second blower 232 such that the flow rate becomes a specified level. With this operation, the flow rate of the air flowing into the material container 201 becomes higher than the flow rate of the air being caused by the second blower 232 to flow out of the material container 201, and accordingly the pressure in the material container 201 becomes positive. Thus, humidified air is appropriately supplied to the material container 201, thereby maintaining the humidity environment in the material container 201.

4. Fourth Embodiment

Next, a fourth embodiment will be described. Note that the same components as in the first embodiment are denoted by the same reference numerals without repetitive description. The present embodiment describes a method of controlling the material storage apparatus 10. Note that the present embodiment describes a control method in a case in which the lid 210 is opened from the closed state to input scraps of paper into the material container 201 when the first blower 223 and the second blower 232 are operating. When the first blower 223 and the second blower 232 are operating, the pressure in the material container 201 is controlled to be positive as in the first embodiment.

Figure 8:
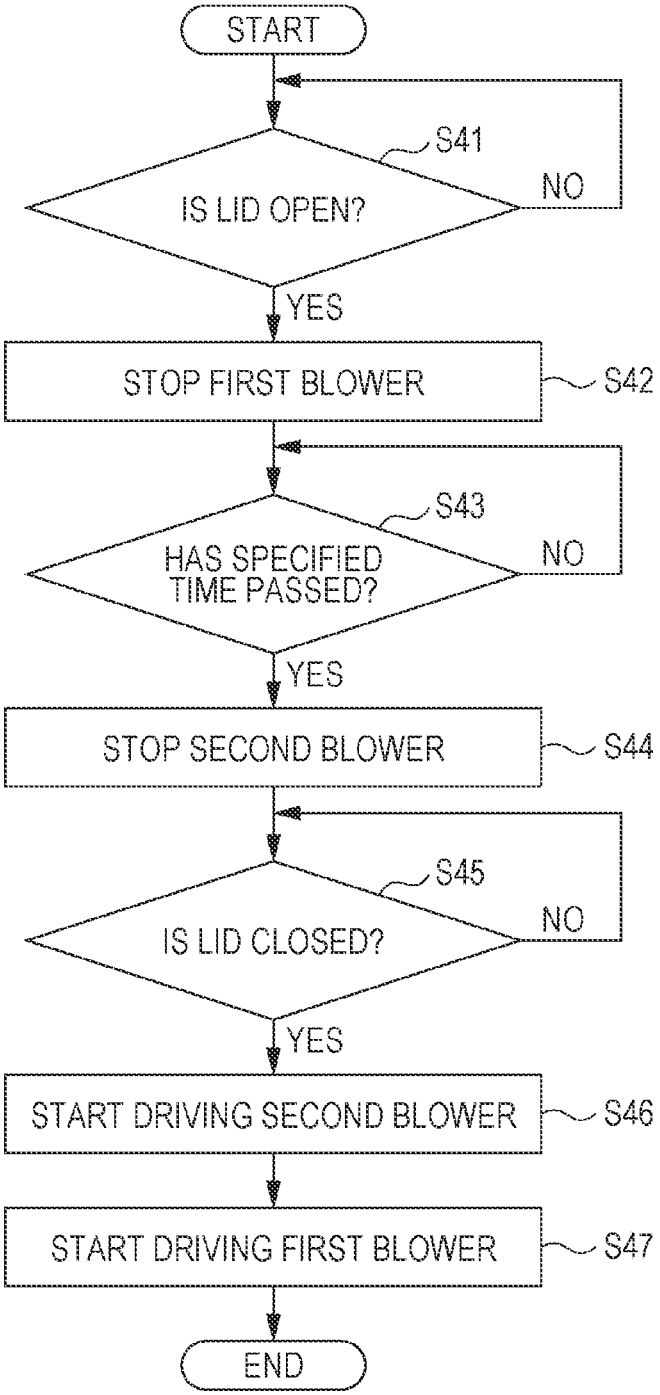
FIG. 8 is a flowchart illustrating a method of controlling the material storage apparatus, according to a fourth embodiment.

As illustrated in FIG. 8, in step S41, the controller 150 determines whether the lid 210 is open. The controller 150 performs the determination in accordance with the detection signal transmitted from the detector 204. When the controller 150 determines that the lid 210 is open (YES), the process proceeds to step S42. In contrast, when the controller 150 determines that the lid 210 is not open, in other words, the lid 210 is closed (NO), the process remains in step S41.

In step S42, the controller 150 stops the first blower 223. Thus, the flow rate of the air flowing into the material container 201 decreases (the flow rate becomes substantially zero). In contrast, the operation of the second blower 232 is maintained. In other words, the pressure in the material container 201 is kept negative. With this operation, the flow rate of the air being caused by the second blower 232 to flow out of the material container 201 becomes higher than the flow rate of the air being caused by the first blower 223 to flow into the material container 201, and accordingly the pressure in the material container 201 becomes negative in a short time.

In step S43, the controller 150 determines whether a specified time has passed since the first blower 223 stopped. The controller 150 measures time with a timer or the like. The specified time is, for example, several seconds or so. When the controller 150 determines that the specified time has passed since the first blower 223 stopped (YES), the process proceeds to step S44. In contrast, when the controller 150 determines that the specified time has not passed since the first blower 223 stopped (NO), the process remains in step S43.

In step S44, the controller 150 stops the second blower 232. In other words, the pressure in the material container 201 is kept negative (in a reduced pressure state) after the first blower 223 stopped until the specified time has passed. When the second blower 232 stops, the flow rate of the air flowing out of the material container 201 decreases (the flow rate becomes substantially zero). Since the second blower 232 is stopped after the first blower 223 is stopped, the pressure in the material container 201 is kept negative. This operation prevents scraps of paper, paper dust, and the like from blowing out through the material inlet 202 when the lid 210 is opened. Hence, scraps of paper can be smoothly input into the material container 201 through the material inlet 202. In addition, stopping both the first blower 223 and the second blower 232 reduces electric power consumption. In addition, stopping the second blower 232 prevents outside dry air from being sucked into the material container 201 through the material inlet 202, mitigating the drying of the scraps of paper in the material container 201. Note that the controller 150 may slow down the second blower 232 instead of stopping it. This configuration also provides the same or similar effects.

In step S45, the controller 150 determines whether the lid 210 is closed. The controller 150 performs the determination in accordance with the detection signal transmitted from the detector 204. When the controller 150 determines that the lid 210 is closed (YES), the process proceeds to step S46. In contrast when the controller 150 determines that the lid 210 is not closed, in other words, the lid 210 is open (NO), the process remains in step S45.

In step S46, the controller 150 starts driving the second blower 232. The controller 150 controls the second blower 232 such that the flow rate becomes a specified level. In step S47, the controller 150 starts driving the first blower 223. The controller 150 controls the first blower 223 such that the flow rate becomes a specified level. With this operation, the flow rate of the air flowing into the material container 201 becomes higher than the flow rate of the air being caused by the second blower 232 to flow out of the material container 201, and accordingly the pressure in the material container 201 becomes positive. Thus, humidified air is appropriately supplied to the material container 201, thereby maintaining the humidity environment in the material container 201.

5. Fifth Embodiment

Next, a fifth embodiment will be described. Note that the same components as in the first embodiment are denoted by the same reference numerals without repetitive description. The present embodiment describes the configuration of a material storage apparatus 10A.

Figure 9:
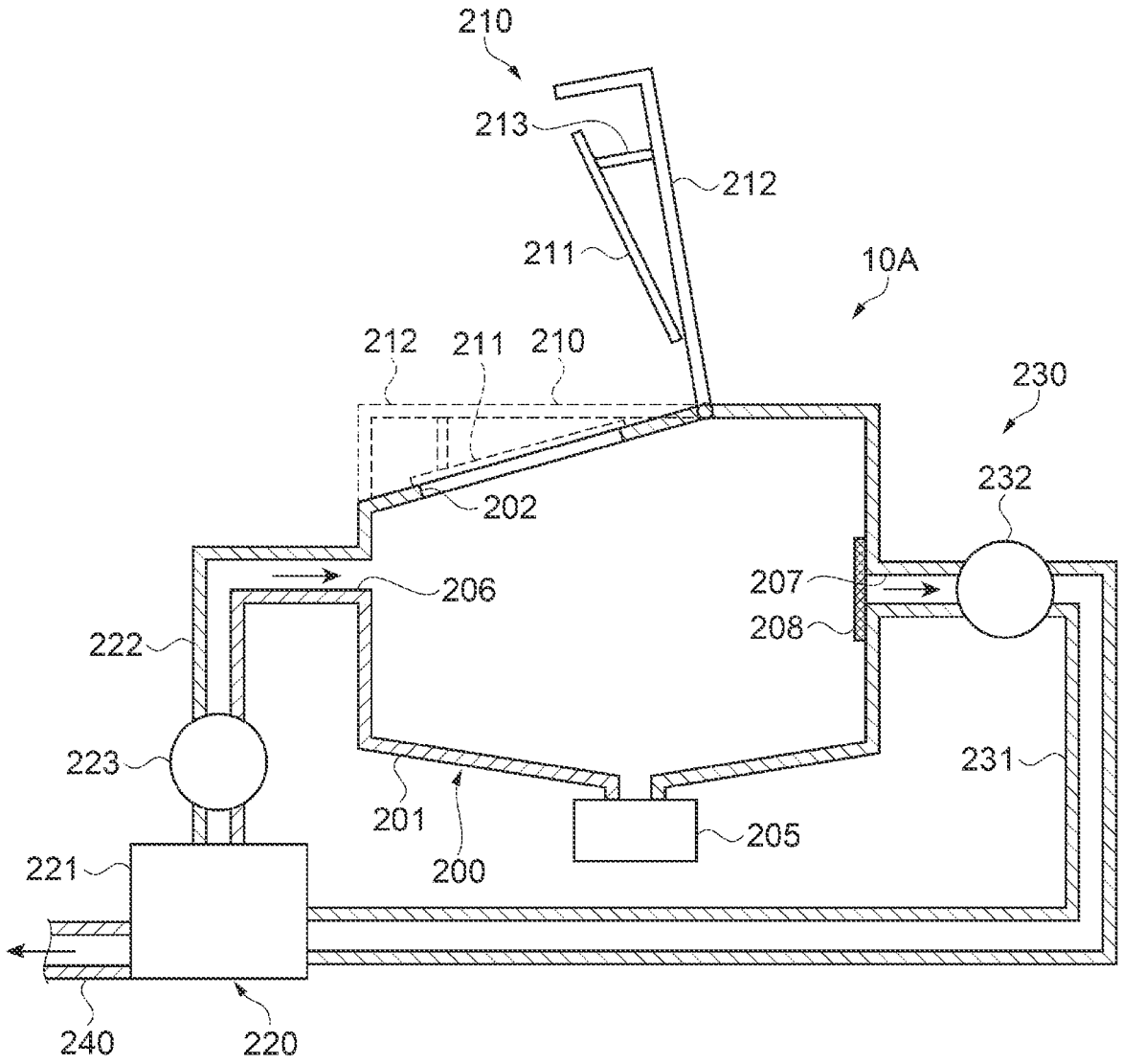
FIG. 9 is a schematic diagram illustrating the configuration of a material storage apparatus according to a fifth embodiment.

As illustrated in FIG. 9, the material storage apparatus 10A includes a material storage portion 200 for storing scraps of paper, a humidification portion 220, and an air circulation portion 230. The material storage apparatus 10A also includes a detector 204 (not illustrated).

In the material storage apparatus 10A of the present embodiment, an outlet pipe 231 of the air circulation portion 230 is coupled to the humidification portion 220 (humidifier 221). In other words, in the material storage apparatus 10A, the humidified air in the material container 201 is returned to the humidification portion 220 through the outlet pipe 231 and is then supplied to the material container 201 through the coupling pipe 222. In the material storage apparatus 10A, the circulation of humidified air reduces the load for the humidification process in the humidifier 221 and enables humidified air to be smoothly supplied into the material container 201. The humidification portion 220 is provided with a discharge pipe 240, which discharges part of the humidified air returning from the air circulation portion 230, to the outside. This configuration makes it possible to adjust the pressure in the air circulation path composed of the coupling pipe 222, the inside of the material container 201, and the outlet pipe 231.

What is claimed is:

1. A material storage apparatus comprising:

a material storage portion configured to store scraps of paper and including a material container and a lid, the material container having a material inlet enabling the scraps of paper to be input into the material container, the lid being configured to open and close the material inlet;

a humidification portion including a first blower and configured to supply humidified air into the material container; and an air circulation portion including a second blower and configured to suck air in the material container, the material container further having an air inlet through which the humidified air that is supplied from the humidification portion flows into an inside of the material container, the air inlet being located higher than a center portion of the material container in a height direction from a bottom of the material container to a top of the material container, wherein when the lid is open, the material container has a negative pressure.

2. The material storage apparatus according to claim 1, further comprising:

a detector configured to detect whether the lid of the material inlet is open or closed; and a controller, wherein when the controller determines that the lid is open, the controller stops the first blower.

3. The material storage apparatus according to claim 1, further comprising:

a detector configured to detect whether the lid of the material inlet is open or closed; and a controller, wherein when the controller determines that the lid is open, the controller slows down the first blower.

4. The material storage apparatus according to claim 1, further comprising:

a detector configured to detect whether the lid of the material inlet is open or closed; and a controller, wherein when the controller determines that the lid is open, the controller stops the first blower and, after a specified time passes, stops the second blower.

5. A sheet manufacturing apparatus comprising the material storage apparatus according to claim 1.

6. A method of controlling a material storage apparatus including a material storage portion configured to store scraps of paper and including a material container and a lid, the material container having a material inlet enabling the scraps of paper to be input into the material container, the lid being configured to open and close the material inlet; a humidification portion including a first blower and configured to supply humidified air into the material container; and an air circulation portion including a second blower and configured to suck air in the material container, the material container further having an air inlet through which the humidified air that is supplied from the humidification portion flows into an inside of the material container, the air inlet being located higher than a center portion of the material container in a height direction from a bottom of the material container to a top of the material container, the method comprising causing the material container to have a negative pressure when the lid is open.

7. The method of controlling a material storage apparatus according to claim 6, further comprising stopping the first blower when the lid is open.

8. The method of controlling a material storage apparatus according to claim 6, further comprising slowing down the first blower when the lid is open.

9. The method of controlling a material storage apparatus according to claim 6, further comprising:

stopping the first blower when the lid is open; and stopping the second blower after a specified time passes.

10. A material storage apparatus comprising:

a material storage portion configured to store scraps of paper and including a material container and a lid, the material container having a material inlet enabling the scraps of paper to be input into the material container, the lid being configured to open and close the material inlet;

a humidification portion including a first blower and configured to supply humidified air into the material container;

an air circulation portion including a second blower and configured to suck air in the material container;

a detector configured to detect whether the lid of the material inlet is open or closed; and a controller, wherein when the lid is open, the material container has a negative pressure, and when the controller determines that the lid is open, the controller slows down the first blower.

* * * * *